United States Patent [19]

Yogo et al.

[11] 4,387,696

[45] Jun. 14, 1983

[54] ELECTROMAGNETICALLY CONTROLLED FUEL INJECTION SYSTEM

[75] Inventors: Kenji Yogo, Nagoya; Isshi Nomura, Aichi, both of Japan

[73] Assignee: Aisin Seiki Kabushiki Kaisha, Kariya, Japan

[21] Appl. No.: 356,404

[22] Filed: Mar. 9, 1982

[30] Foreign Application Priority Data

Mar. 9, 1981 [JP] Japan ..... 56-33526

[51] Int. Cl.[3] ..... F02B 3/00

[52] U.S. Cl. ..... 123/585; 123/472; 123/531; 239/407; 239/585

[58] Field of Search ..... 123/585, 531, 472; 239/407, 408, 409, 585

[56] References Cited

U.S. PATENT DOCUMENTS

| | | | |
|---|---|---|---|
| 2,127,165 | 8/1938 | Ehrat | 123/531 |
| 2,146,265 | 2/1939 | Moore | 123/531 |
| 2,960,976 | 11/1960 | Cassell et al. | 123/531 |
| 3,285,233 | 11/1966 | Jackson | 123/531 |
| 3,826,233 | 7/1974 | Mennesson | 123/472 |
| 3,882,828 | 5/1975 | Honiden | 123/531 |
| 3,996,906 | 12/1976 | Bubniak | 239/408 |
| 4,159,703 | 7/1979 | Mayer | 123/472 |

*Primary Examiner*—Ronald B. Cox

*Attorney, Agent, or Firm*—Oblon, Fisher, Spivak, McClelland & Maier

[57] ABSTRACT

An electromagnetically controlled fuel injection system which includes a mechanism for sensing a plurality of operating conditions of a combustion engine and for generating a plurality of electric signals corresponding to the conditions, an electrical control unit receiving the first electric signals to thereby generate a second electric signal in response thereto, an electromagnetically controlled fuel injection valve mechanism controlled by the second signal from the electrical control unit and having a fuel injection port formed therein and an electromechanically controlled air supply valve mechanism provided with an air supply port around the fuel injection port of the fuel injection valve and controlled by the second signal from the electric control unit.

4 Claims, 2 Drawing Figures

ELECTROMAGNETICALLY CONTROLLED FUEL INJECTION SYSTEM

BACKGROUND OF THE INVENTION

1. Field of the Invention

This invention relates to an electromagnetically controlled fuel injection system, and more particularly to an electromagnetically controlled system for increasing the vaporization of injected fuel.

2. Description of the Prior Art

A conventional electromagnetically controlled fuel injection system includes an electromagnetically controlled fuel injection valve and a fuel injection port of the fuel injection valve positioned at an intake manifold portion of an internal combustion engine. Therefore, this results in a shortened time period wherein injected fuel is exposed to the air stream from an air cleaner to a combustion chamber in comparison with a carburetor type system having a venturi portion to which fuel is supplied. The vaporization of the injected fuel is not sufficiently promoted by the air stream and therefore is not mixed uniformly with air. Moreover, rich and lean portions exist in the fuel density distribution in the combustion chamber. Therefore, misfiring or premature detonation may be caused when ignition occurs. Moreover, fuel particles which adhere to the inner wall of the combustion chamber gather near the top of the piston in accordance with movement of the piston. As gathered fuel particles burn at the top of the piston, the piston rings are badly damaged.

Accordingly, in another conventional electromagnetically controlled fuel injection system, an air supply path is formed so as to be open around the injection port of the fuel injection valve. Air is therefore continuously supplied for increasing the vaporization of injected fuel.

However, since an adequate supply of air to urge the vaporization is constantly maintained, the ratio of air and fuel will become too lean in an idling condition in which the supply of fuel is relatively small. This means that the stability of idle engine revolution is lessened. If the supply of fuel is increased in order to obtain an optimum air-fuel ration, the number of idle engine revolutions may be increased so as to be more than is required.

SUMMARY OF THE INVENTION

It is an object of the present invention to provide a new and improved electromagnetically controlled fuel injection system which obviates the above-mentioned drawbacks of the prior art.

It is a further object of the present invention to provide a new and improved electromagnetically controlled fuel injection system in which air is supplied for increasing the vaporization of injected fuel while the fuel is being injected.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

Figure 1:
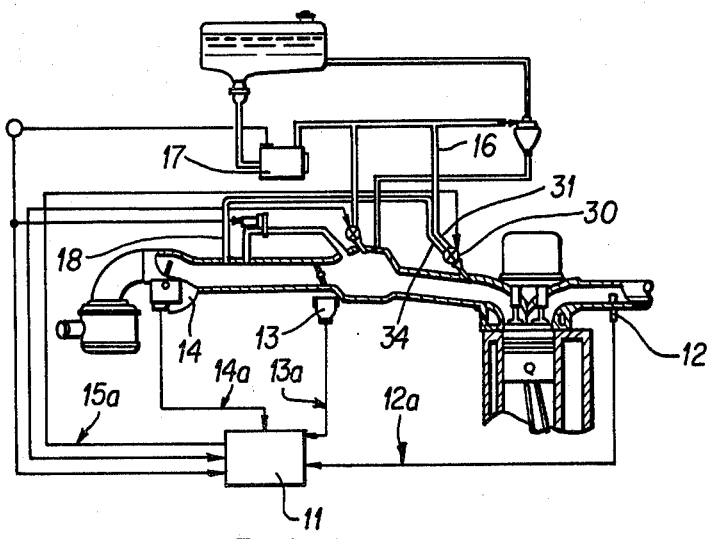
FIG. 1 shows an electromagnetically controlled fuel injection system according to the present invention.

In FIG. 1, showing an electromagnetically injection system according to the present invention, an $O_2$ sensor 12 is secured at an exhaust manifold of the vehicle engine and a throttle position sensor 13 is integrally arranged with a throttle valve. An air flow meter 14 is mounted to detect the quantity of air flow from the air cleaner.

Electrical output signals 12*a*, 13*a* and 14*a* from the $O_2$ sensor 12, the throttle position sensor 13 and the air flow meter 14, respectively, are supplied to an electrical control unit 11. Control unit 11 judges the operating conditions of the combustion engine and the required quantity of fuel from these signals and generates an electrical signal 15*a* for controlling the quantity of injected fuel. Output signal 15*a* is an electrical pulse which has a predetermined current value for a predetermined time period.

Output signal 15*a* is supplied to a vaporization increasing device 30. A fuel inlet port 31 of the vaporization increasing device 30 is connected to a fuel pump 17 through a pipe 16 to be provided with pressurized fuel. An air inlet port 34 is connected to the air bypass 18 which is branched downstream of the air cleaner.

Figure 2:
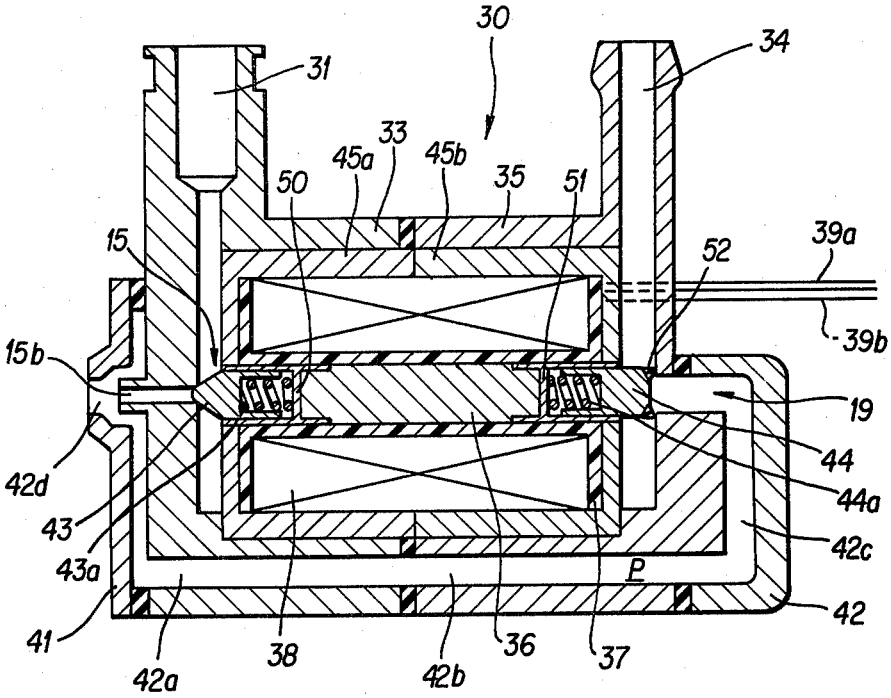
FIG. 2 shows a sectional view of a vaporization increasing device which includes a fuel injection valve and an air supply valve which is utilized in the fuel injection system in FIG. 1.

In FIG. 2, the vaporization increasing device 30 according to the present invention includes an electrically controlled fuel injection valve 15 and an air supply valve 19. A first body 33 has the fuel inlet port 31, the fuel injection port 15*b* and an air passage 42*a*. A second body 35 has an air inlet port 34 and an air passage 42*b*. These bodies are secured to each other through a seal member and a fixed core 36 is coaxially positioned therein.

A bobbin 37 of resin material is mounted on the fixed core 36 and an electromagnetic coil 38 is wound on the bobbin 37. Each end of the coil 38 is electrically connected to each wire 39*a*, 39*b* and the electrical pulse signal 15*a* is supplied to the coil 38. This electromagnetic coil 38 is covered with yokes 45*a*, 45*b* made of magnetic material, such as, for example, iron.

A first cover 41 having an air supply port 42*d* is secured to the first body 33 through a seal member and a second cover 42 having an air passage 42*c* is secured to the second body 35 through a seal member so as to form an air passage P composed of air passages 42*a*, 42*b* and 42*c*, air supply port 42*d* being in communication with air passage P and being positioned around the fuel injection port 15*b*.

The fuel injection valve 15 includes a movable core 43 made of magnetic material such as iron which is positioned at the left side of the fixed core 36 through non-magnetic material 50 and which is biased against the fuel injection port 15*b* by a return spring 43*a*. The air supply valve 19 includes a second movable core 44 made of magnetic material such as iron which is positioned at the right side of the fixed core 36 through non-magnetic material 51 and which is biased against a seat 52 provided on the body 35.

In operation, the electric control unit 11 judges the conditions of the engine and required fuel in accordance with output signals 12*a*, 13*a*, 14*a* from $O_2$ sensor 12, throttle position sensor 13 and air flow meter 14 and generates the electric pulse signal 15*a*. This pulse signal 15*a* is supplied to the magnetic coil 38.

When the magnetic coil 38 does not receive pulse signal 15*a*, the fuel injection valve 15 and the air supply valve 19 are closed by the biasing force of springs 43*a*, 44*a*, as illustrated in FIG. 2. When the signal 15*a* is generated, the coil 38 is energized and magnetic flux is generated. This magnetic flux flows through a magnetic circuit in the form of fixed core 36, movable cores 43, 44, and yokes 45*a*, 45*b*. Each movable core 43, 44 moves to the fixed core 36 against the corresponding biasing springs 43*a*, 44*a*. The fuel injection valve 15 and air supply valve 19 therefore are simultaneously open. Accordingly, fuel is injected and air is also supplied to increase vaporization of injected fuel.

When a sufficient quantity of fuel is supplied, the electric control unit 11 will no longer generate the signal 15*a*. As magnetic flux is not generated, movable cores 43, 44 are biased by springs 43*a*, 44*a* to their original positions. The fuel injection valve 15 and air supply valve 19 are closed as shown in FIG. 2 and the injection of fuel and the supply of air are simultaneously stopped.

In the electromagnetically controlled fuel injection system of the present invention, air is supplied only while fuel is injected and enough air can be supplied as compared to the injected fuel in order to increase vaporization of fuel and the suitable ratio of fuel and air for the combustion engine will not be decreased.

As supplied air is reduced as a whole, the vacuum near the air supply port 42*d* is kept at a high value and the flow speed of supplied air is faster. Therefore, the inside diameter of fuel injection port 15*b* can become smaller so as to accelerate the vaporization of injected fuel.

When fuel injection valve 15 and air supply valve 19 are independently formed, the electric control unit should generate time signals to thereby operate valves 15, 19. In this case, it is desirable that the signal supplied to air supply valve 19 is transmitted earlier and stops later than the signal supplied to fuel injection valve 15.

Obviously, numerous modifications and variations of the present invention are possible in light of the above teachings. It is to be understood, therefore, that within the scope of the appended claims, the invention may be practiced otherwise that as specifically described herein.

What is claimed as new and desired to be secured by Letters Patent of the United States is:

1. An electromagnetically controlled fuel injection system, comprising:

means for sensing a plurality of operating conditions of a combustion engine and for generating a plurality of electric signals corresponding to said conditions;

an electrical control unit receiving said first electric signals to thereby generate a second electric signal in response thereto;

electromagnetically controlled fuel injection valve means controlled by said second signal from said electrical control unit and having a fuel injection port; and electromagnetically controlled air supply valve means provided with an air supply port around said fuel injection port of said fuel injection valve means and controlled by said second signal from said electric control unit.

2. An electromagnetically controlled fuel injection system as set forth in claim 1, further comprising an electromagnetic coil connected to said electrical control unit, a bobbin, and a fixed core member disposed within said coil and said bobbin wherein said fuel injection valve means and said air supply valve means each further comprises a movable core member and corresponding valve seat such that each of said movable core members are operatively associated with said fixed core.

3. An electromagnetically controlled fuel injection system as set forth in claim 2, further comprising biasing means interposed between said fixed core and each of said movable cores for biasing each of said movable cores in a direction so as to contact said corresponding valve seats upon discontinuation of generation of said second signal.

4. An electromagnetically controlled fuel injection system as set forth in claim 3, further comprising a non-magnetic material member interposed between each of said movable cores and said fixed core for insulating said movable cores from said fixed core, said bobbin and said coil.

* * * * *